US007933424B2

(12) United States Patent
Klinkby et al.

(10) Patent No.: US 7,933,424 B2
(45) Date of Patent: Apr. 26, 2011

(54) HEARING AID COMPRISING ADAPTIVE FEEDBACK SUPPRESSION SYSTEM

(75) Inventors: Kristian Tjalfe Klinkby, Vaerloese (DK); Peter Magnus Norgaard, Frederiksberg (DK); Jorgen Cederberg, Frederiksberg (DK)

(73) Assignee: Widex A/S, Lynge (DK)

( * ) Notice: Subject to any disclaimer, the term of this patent is extended or adjusted under 35 U.S.C. 154(b) by 1270 days.

(21) Appl. No.: 11/514,081

(22) Filed: Sep. 1, 2006

(65) Prior Publication Data

US 2006/0291681 A1 Dec. 28, 2006

Related U.S. Application Data

(63) Continuation-in-part of application No. PCT/EP2004/002135, filed on Mar. 3, 2004.

(51) Int. Cl.
*H04R 25/00* (2006.01)

(52) U.S. Cl. ..... 381/317; 381/318

(58) Field of Classification Search ..... 381/71.1, 381/71.11, 71.6, 317, 318
See application file for complete search history.

(56) References Cited

U.S. PATENT DOCUMENTS

| | | | | |
|---|---|---|---|---|
| 5,991,417 | A | 11/1999 | Topholm | |
| 6,097,824 | A | 8/2000 | Lindemann et al. | |
| 2003/0012391 | A1* | 1/2003 | Armstrong et al. | 381/317 |
| 2003/0053647 | A1* | 3/2003 | Kates | 381/318 |

FOREIGN PATENT DOCUMENTS

| | | |
|---|---|---|
| WO | WO 00/19605 | 4/2000 |

OTHER PUBLICATIONS

Philipp A. Regalia, "Adaptive IIR Filtering in Signal processing and Control", 1995 (Title page).
Bernard Widrow et al, "Adaptive Signal Processing", 1985 (Title page).
Simon Haykin, "Adaptive Filter Theory", 1996 (Title page).
Lennart Ljung, "System Identification: Theory for the User", 1987 (Title page).
Lennart Rad et al, Beta Mathematics Handbook—1990, p. 335.

* cited by examiner

*Primary Examiner* — Brian Ensey
(74) *Attorney, Agent, or Firm* — Sughrue Mion, PLLC

(57) ABSTRACT

A hearing aid comprises an input transducer (2), a subtraction node for subtracting a feedback cancellation signal from the electrical input signal thereby generating a processor input signal, a signal processor (3), an output transducer (4), a pair of equalization filters (7*a*, 7*b*) for selecting from the processor input and output signals a plurality of frequency band signals, a frequency equalization unit for frequency equalization for the selected frequency band signals, and an adaptive feedback estimation filter (5, 6) for adaptively deriving the feedback cancellation signal from the equalized frequency band signals. The equalization of selected frequency bands of the input signals of the adaptive feedback cancellation filter provides for an improved and in particular a faster adaption of the feedback cancellation. The invention further provides a method of reducing acoustic feedback of a hearing aid, and a hearing aid circuit.

21 Claims, 9 Drawing Sheets

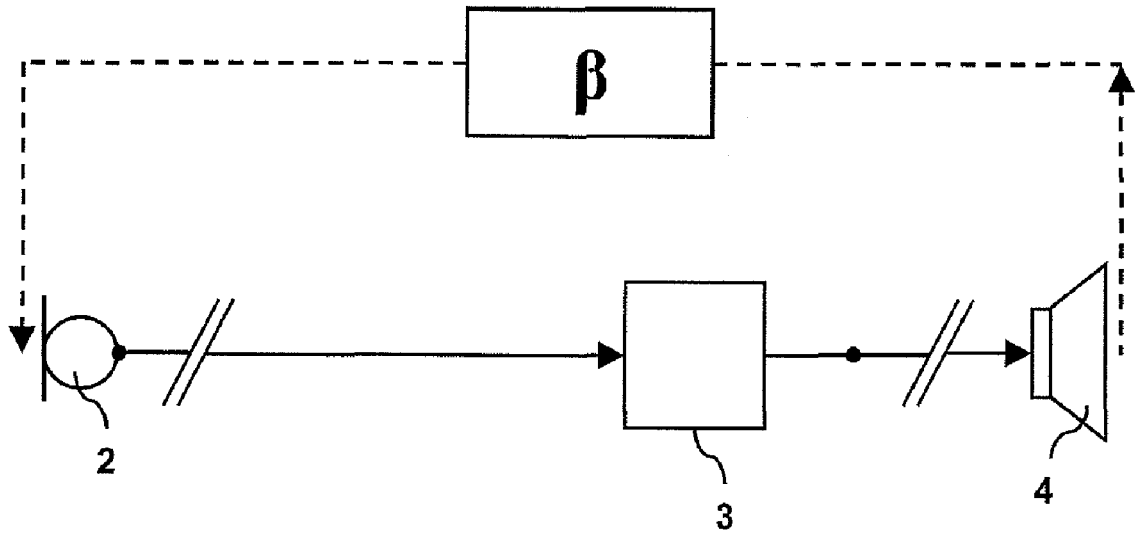
Prior Art Fig. 1
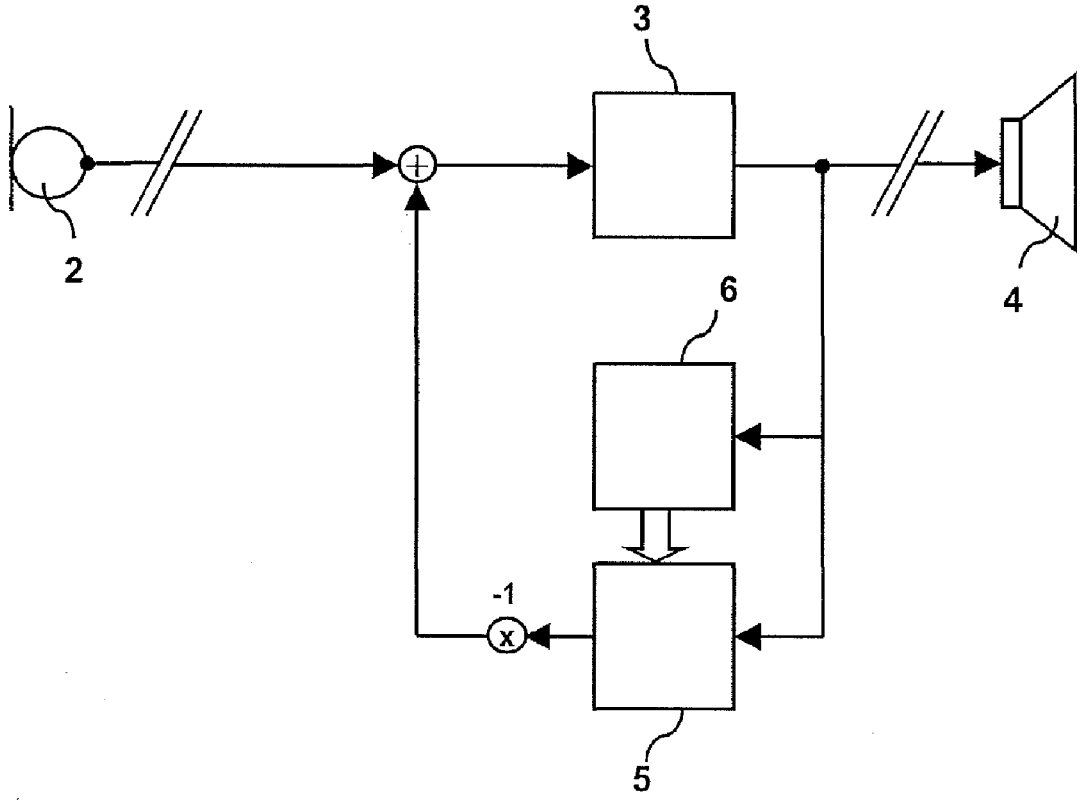
Prior Art Fig. 2

HEARING AID COMPRISING ADAPTIVE FEEDBACK SUPPRESSION SYSTEM

RELATED APPLICATIONS

The present application is a continuation-in-part of application no. PCT/EP2004/002135, filed on Mar. 3, 2004, with The European Patent Office and published as WO 2005/096670 A1.

BACKGROUND OF THE INVENTION

1. Field of the Invention

The invention relates to the field of hearing aids. The invention, more specifically, relates to a hearing aid having an adaptive filter for generating a feedback cancellation signal, to a method of reducing acoustic feedback of a hearing aid and to a hearing aid circuit.

2. The Prior Art

Acoustic feedback occurs in all hearing instruments when sounds leak from the vent or seal between the ear mould and the ear canal. In most cases, acoustic feedback is not audible. But when in-situ gain of the hearing aid is sufficiently high or when a larger than optimal size vent is used, the output of the hearing aid generated within the ear canal can exceed the attenuation offered by the ear mould/shell. The output of the hearing aid then becomes unstable and the once-inaudible acoustic feedback becomes audible, i.e. in the form of a whistling or howling noise. For many users and people around, such audible acoustic feedback is an annoyance and even an embarrassment. In addition, hearing instruments that are at the verge of howling, i.e. show sub-oscillatory feedback, may corrupt the frequency characteristic and may exhibit intermittent whistling. Acoustic feedback is in particular an important problem in CIC (Complete In the Canal) hearing aids with a vent opening since the vent opening and the short distance between the output and the input transducers of the hearing aid lead to a low attenuation of the acoustic feedback path from the output transducer to the input transducer, and the short delay time maintains correlation in the signal.

To suppress undesired feedback it is well-known in the art to include an adaptive filter in the hearing aid to compensate for the feedback. The adaptive filter estimates the transfer function from output to input of the hearing aid including the acoustic propagation path from the output transducer to the input transducer. The input of the adaptive filter is connected to the output of the hearing aid, and the output signal of the adaptive filter is subtracted from the input transducer signal to compensate for the acoustic feedback. A hearing aid of this kind is disclosed, e.g. in WO 02/25996 A1, which document is incorporated herein by reference. In such a system, the adaptive filter operates to remove correlation from the input signal. Some signals representing e.g. speech or music, however, are signals with significant auto-correlation. Thus, the adaptive filter can not be allowed to adapt too quickly since removal of correlation from signals representing speech or music will distort the signals, and such distortion is of course undesired. Therefore, the convergence rate of adaptive filters in known hearing aids is a compromise between a desired high convergence rate that is able to cope with sudden changes in the acoustic environment and a desired low convergence rate that ensures that signals representing speech and music remain undistorted.

As adaptive feedback estimation filter one may employ a finite impulse response (FIR) filter, a warped filter such as a warped FIR filter or a warped infinite impulse response (IIR) filter etc. Such filter types are described in detail in the WO 02/25996 A1.

An overview of adaptive filtering is given in the textbook of Philipp A. Regalia: "Adaptive IIR filtering in signal processing and control", published in 1995.

For a number of reasons, it may be desirable to equalize, or in the ideal case to whiten, the signals input to the adaptive feedback estimation filter. The advantages of signal equalization are particularly pronounced when a least mean square (LMS) type algorithm is utilized for feedback estimation.

Whitening of a signal is equivalent to orthogonalization or decorrelation of the FIR filter nodes corresponding to the autocorrelation matrix for the reference signal being transformed to a diagonal matrix having identical diagonal elements. This has certain useful consequences: The adaptation occurs at the same rate for all filter coefficients because the variance of each node is the same. The adaptation is generally faster as the performance is similar to that of an RLS (Recursive Least Squares) algorithm because there is no useful information in the second-order derivative of the underlying cost function as the autocorrelation matrix is a diagonal matrix. In addition, in some circumstances the adaptation error is also more evenly distributed over the frequency spectrum.

A further problem associated with adaptive feedback suppression in hearing aids is the following: For the same user, the acoustic feedback in hearing aids varies over time depending on yawning, chewing, talking, cerumen, etc. However, certain characteristics can be regarded as valid in most situations. Most notably, acoustic feedback is far weaker for frequencies below 1-1.3 kHz than at higher frequencies. Moreover, the problem of feedback is also limited at frequencies above 10 kHz as most hearing aid receivers produce little sound above this frequency. Additionally, most users have smaller hearing losses at lower frequencies than at higher frequencies. Thus, the hearing aid gain tends to be low (or even zero) in some frequency ranges making these frequency ranges less subject to feedback problems. When designing a feedback canceling system, it therefore makes sense to somehow emphasize frequency ranges where the canceling must perform particularly well. This, however, conflicts with the desire to equalize or decorrelate a signal as described above. There is therefore the problem of finding the right balance between frequency equalization or whitening providing a desired decorrelation or orthogonalization of the adaptive filter input signal and the appropriate frequency weighting of the adaptive filter input signal removing frequencies not relevant for feedback suppression.

SUMMARY OF THE INVENTION

It is an object of the present invention to provide a hearing aid having a feedback cancellation system with improved feedback-cancellation and adaptation properties. It is a further object of the invention to provide a method of reducing acoustic feedback of a hearing aid having improved feedback-cancellation and adaptation properties.

The invention, in a first aspect, provides a hearing aid comprising an input transducer for transforming an acoustic input into an electrical input signal, a subtraction node for subtracting a feedback cancellation signal from the electrical input signal thereby generating a processor input signal, a signal processor for deriving a processor output signal from the processor input signal, an output transducer for deriving an acoustic output from the processor output signal, a pair of equalization filters having a frequency selection unit for respectively selecting from the processor input and output signals a plurality of frequency band signals and a frequency equalization unit for frequency equalizing the selected frequency band signals, and an adaptive feedback estimation filter for adaptively deriving the feedback cancellation signal from the equalized frequency band signals.

The equalization filtering of selected frequency bands of the input signals of the adaptive feedback estimation filter allows a frequency equalization and decorrelation of the signal in those frequency bands relevant for feedback cancellation, whereas other, irrelevant frequency ranges, e.g. lower frequencies are ignored. This results in a faster and more uniform adaptation speed of the feedback cancellation system.

According to one embodiment of the invention, the pair of frequency equalization filters includes a first, adaptive equalization filter comprising an adaptive frequency equalization unit for adaptively frequency equalizing the selected frequency band signals based on a control signal, and a second non-adaptive equalization filter inheriting the equalization properties of the first, adaptive equalization filter. Either the processor output signal (reference signal) or the processor input signal (error signal) may be adaptively equalized, and the other signal is equalized using the same equalization properties.

Preferably, a common control signal controls the gain of the plurality of frequency band signals of the adaptive equalization filter. The control signal may be an external signal such as an adjustable value, or an internal signal derived from an averaged absolute value of one of the frequency band signals of the adaptive equalization filter (e.g the one with the lowest averaged sound pressure signal).

The first equalization filter may comprise a plurality of band-pass filters serving as frequency selection unit, a plurality of absolute average calculation units for calculating averaged absolute values of the plurality of frequency band signals and a plurality of gain regulation units deriving a plurality of gain factor signals dependent on a difference between the control signal and averaged absolute values of the respective gain adjusted frequency band signals.

The adaptive equalization filter preferably comprises a plurality of multipliers for multiplying the frequency band signals with the gain factor signal generating the gain adjusted frequency band signal. The multipliers may be connected before or behind the corresponding bandpass filters, or the gain settings of the bandpass filters can be adjusted directly. A separate, second multiplier for every frequency band may be provided, connected between the absolute average calculation unit and the gain regulation unit. This arrangement allows a particularly fast gain adjustment.

The invention, in a second aspect, provides a method of reducing acoustic feedback of a hearing aid having a signal processor for processing a processor input signal derived from an acoustic input and a feedback cancellation signal, and generating a processor output signal, the method comprising the steps of selecting from the processor input signals and output signals a plurality of frequency band signals, frequency equalizing the selected frequency band signals, and adaptively deriving a feedback cancellation signal from the equalized frequency band signals.

The invention, in a third aspect, provides a computer program product comprising program code for performing, when run on a computer, a method of reducing acoustic feedback of a hearing aid comprising a signal processor for processing a processor input signal derived from an acoustic input and a feedback cancellation signal, and generating a processor output signal, the method comprising the steps of: selecting from the processor input signals and output signals a plurality of frequency band signals, frequency equalizing the selected frequency band signals, and adaptively deriving a feedback cancellation signal from the equalized frequency band signals.

The invention, in a fourth aspect, provides a hearing aid circuit comprising: a signal processor for processing a processor input signal derived from an acoustic input and a feedback cancellation signal, and generating a processor output signal, a pair of equalization filters comprising: a frequency selection unit for respectively selecting from the processor input signals and output signals a plurality of frequency band signals, a frequency equalization unit for frequency equalization for the selected band signal, an adaptive feedback estimation filter for adaptively deriving a feedback cancellation signal from the equalized frequency band signals.

Further specific variations of the invention are defined by the further dependent claims.

BRIEF DESCRIPTION OF THE DRAWINGS

The present invention and further features and advantages thereof will be more readily apparent from the following detailed description of particular embodiments thereof with reference to the drawings, in which:

FIG. 1 is a schematic block diagram illustrating the acoustic feedback path of a hearing aid;

FIG. 2 is a block diagram showing a prior art hearing aid having an adaptive feedback cancellation system;

DETAILED DESCRIPTION OF THE INVENTION

Figure 3:
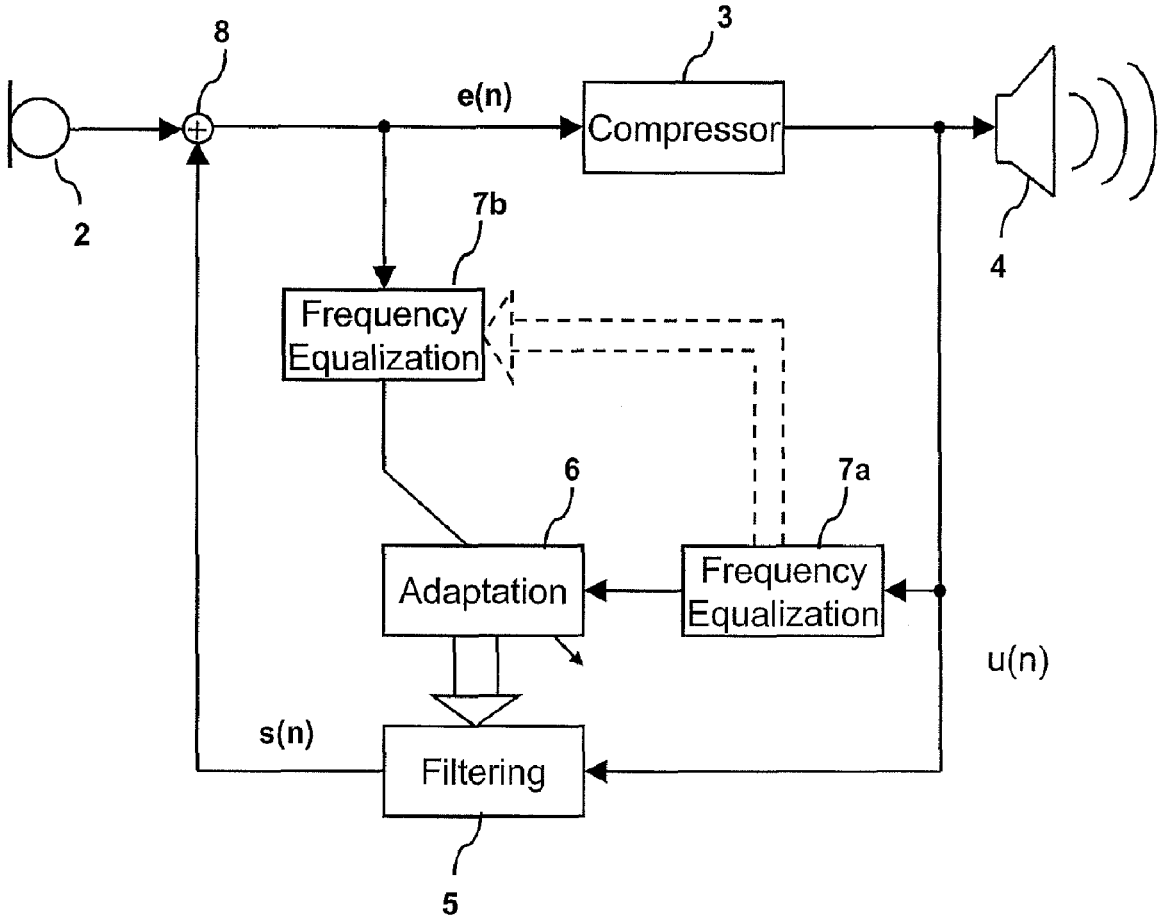
FIG. 3 is a schematic block diagram illustrating an embodiment of a hearing aid according to the present invention.

FIG. 1 shows a simple block diagram of a hearing aid comprising an input transducer or microphone 2 transforming an acoustic input into an electrical input signal, a signal processor or compressor 3 amplifying the input signal and generating a processor output signal and finally an output transducer or receiver 4 for transforming the processor output signal into an acoustic output. The acoustic feedback path of the hearing aid is depicted by broken arrows, whereby the attenuation vector is denoted by $\beta$. If, in a certain frequency range, the product of the gain G (including transformation efficiency of microphone and receiver) of the processor 3 and the attenuation $\beta$ is close to 1, audible acoustic feedback occurs.

FIG. 2 shows an adaptive feedback suppression system schematically. The output signal from signal processor 3 (reference signal) is fed to an adaptive estimation filter 5. A filter control unit 6 controls the adaptive filter, e.g. the convergence rate or speed of the adaptive filtering and the relevant filter coefficients. The adaptive filter constantly monitors the feedback path, providing an estimate of the feedback signal. Based on this estimate, a feedback cancellation signal is generated which is then fed into the signal path of the hearing aid in order to reduce, or in the ideal case to eliminate, acoustic feedback.

FIG. 3 shows a block diagram of an embodiment of a hearing aid according to the present invention.

An acoustic input is transformed by microphone 2 into an electrical input signal from which the feedback cancellation signal s(n) is subtracted at summing node 8 resulting in error signal e(n), which is in turn submitted as processor input signal to the hearing aid processor or compressor 3 generating an amplified processor output signal or reference signal u(n). An output transducer (loudspeaker, receiver) 4 is provided for transforming the processor output signal into an acoustic output. The amplification characteristic of compressor 3 may be non-linear providing more gain at low signal levels and may show compression characteristics as it is well-known in the art. Reference signal u(n) is input to adaptive frequency equalization filter 7*a* described in more detail later. Error signal e(n) is input to frequency equalization filter 7*b*, the equalization properties of which are inherited from the first, adaptive frequency equalization filter 7*a*. Frequency equalized reference signal and frequency equalized error signal are then fed to control unit 6 controlling the adaptation of adaptive feedback estimation filter 5.

According to an alternative embodiment, the adaptive equalization is performed on the error signal e(n), and the respective gain adjustment factors are copied to the equalization filter applied to reference signal u(n).

The adaptive feedback estimation filter 5 including control unit 6 monitors the feedback path and consists of an adaptation algorithm adjusting a digital filter such that it simulates the acoustic feedback path and so provides an estimate of the acoustic feedback in order to generate feedback cancellation signal s(n) modeling the actual acoustic feedback path. The filter coefficients of adaptive filter 5 are adapted by control unit 6.

One basic concept of the present invention is the frequency equalization or, in the ideal case, the whitening of the feedback cancellation filter input signals. Equalization or decorrelation should here be interpreted as the process of making the signal spectrum flatter, i.e. less varying. A complete decorrelation of a signal is usually referred to as whitening and means that the signal spectrum takes the same amplitude for all frequencies below the Nyquist frequency. Adaptive whitening filters are well-known from the literature, e.g. Widrow and Stearns: "Adaptive Signal Processing", 1985.

If the spectrum of a cancellation filter input signal, e.g. the reference signal, has highly dominating values at certain frequencies, the adaptive cancellation filter will under mild conditions fit particularly well to the acoustic feedback path for these frequency components while for other frequencies, a poor fit is to be expected. By equalizing the frequency spectrum, more evenly distributed adaptation results can be attained. The error minimization process will cause an evenly distributed estimation error and a more uniform adaptation time constant over the frequency spectrum. An associated effect is that a faster adaptation is possible using an equalized signal for adaptive feedback cancellation because the eigenvalue spread of the reference signal is reduced (see Haykin, "Adaptive Filter Theory", Prentice Hall, 2002).

Whitening can be performed in different ways. Which method is to be preferred depends on objectives such as the desired accuracy and the computational burden. The methods include i. Direct adaptation of a linear FIR or IIR filter to orthogonalize an input signal. This is similar to an adaptive linear prediction.

ii. Calculation of a Discrete Fourier Transformation (DFT) and equalization of each frequency bin to the same magnitude followed by an inverse DFT.

iii. A filter bank of band pass filters and adaptation of each band level to flatten the spectrum, i.e. to the same level if all bands have the same bandwidth. Subsequently the frequency band signals are added to get the equalized signal.

Although the embodiments described in the following employ method (iii.), the other methods may also be utilized in accordance with the present application.

The second basic concept of the present application is frequency weighting. This means that for the adaptation process for feedback cancelling only those frequencies should be taken into account for which the occurrence of acoustic feedback is likely, like the frequencies between about 1 kHz and about 10 kHz. For feedback cancellation, a frequency range is selected where the cancellation must fit the acoustic feedback path particularly well. By omitting frequencies below 1 kHz, for example, it is possible to allow the adaptive cancellation filter to make arbitrary large errors in the low-frequency range without compromising closed-loop stability or risking audible artifacts.

By performing a frequency equalization in a number of selected frequency bands, the present invention can exploit the advantages of both concepts, frequency whitening and frequency weighting. On the one hand, a fast and uniform adaptation is possible with the decorrelated adaptation input signal and on the other hand only relevant frequency bands can be selected for feedback cancellation processing. Both concepts can be applied simultaneously if the frequency selection is made first, and the equalization is then performed subsequently on the basis of the selected frequencies.

If both concepts are addressed independenty, this generally leads to a solution with undesired characteristics. In such a design, described in S. Haykin, "Adaptive Filter Theory", Prentice Hall, 2002, an adaptive whitening filter e.g. based on a linear predictor model is first applied to the signal and subsequently the whitened signal is high-pass or band-pass filtered to emphasize the desired frequency range. The drawback of this approach is that "undesired" frequency components (those that will be filtered out in the succeeding weighting filter) influence the adaptation of the whitening filter. E.g. if the signal is a speech signal of which the signal energy is mostly concentrated at low frequencies, the equalizing filter adaptation will pay little attention to the variation in the spectrum over the high frequency range.

In contrast thereto it is an important advantage of the present invention that it is possible to quickly flatten the spectrum in the high frequency range or any other selected frequency range independently of the low-frequency contents of the signal.

From the theory of system identification based on minimization of the expectation of the squared prediction error given in Ljung: "System Identification—Theory for the User", Prentice Hall, 1987, it is possible to derive the influence of different spectral distributions of the signal on the adaptation algorithm based on a least mean square error algorithm in the open-loop case. For a given frequency range in which a relatively large proportion of the signal energy is concentrated, the error minimization process works well since this frequency range also has a large weight in the cost function. The opposite, however, is the case for frequency ranges where a smaller proportion of the signal energy is concentrated. The minimization error may well be small despite that the model error is significant.

Since according to the present invention the signal spectrum is equalized in a selected frequency range (which is relevant for feedback cancellation) the adaptation error minimization process will cause an evenly distributed estimation error over the selected frequency range thus avoiding undesired signal distortions.

Figure 10:
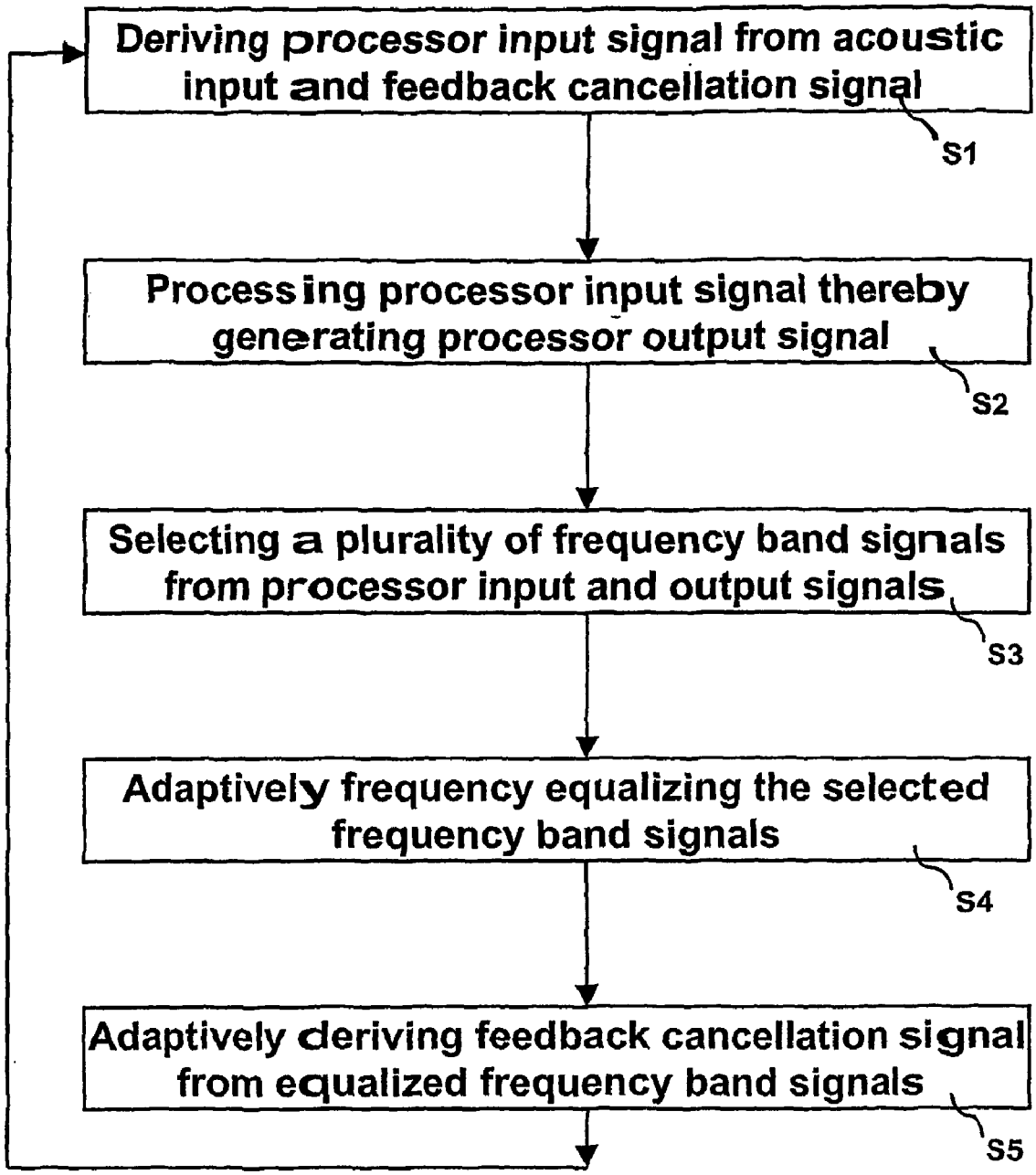
FIG. 10 is a flow chart illustrating an embodiment of a method of feedback suppression according to the present invention.

A particular embodiment of the method of suppressing acoustic feedback in a hearing aid is schematically illustrated in FIG. 10.

In method step S1 a processor input signal is derived from the acoustic input by the input transducer (microphone) and a feedback cancellation signal, which is subtracted from the microphone output signal. The hearing aid processor or compressor then, in subsequent method step S2, generates the processor output signal, which is then fed to the receiver. In step S3 a plurality of frequency band signals relevant for the feedback suppression are selected from the processor input signal and the processor output signal. The selected frequency band signals are then, in method step S4, adaptively frequency equalized as described above and submitted to the adaptive feedback estimation filter for calculating the feedback cancellation signal in method step S5, which signal is subtracted from the microphone output signal in method step S1.

According to a preferred embodiment, the frequency equalization gain factors are adaptively calculated for the reference signal and, in order not to distort the signal, are then copied to the equalization filter for the error signal (processor input signal). As mentioned above, a similar adaptation rate for all filter coefficients in the subsequent feedback canceling filter will be obtained by adaptively equalizing the reference signal when the feedback canceling filter is of FIR, warped FIR, or a similar structure.

By selecting certain frequency bands of the reference signal it is possible to modify the spectrum, thereby altering the weighting of the model accuracy. If, for example, a stop-band filter is used for frequency selection it will have the effect that the feedback cancellation adaptation can generate arbitrary large errors in the stop band without affecting the cost function.

Instead of adaptively equalizing the reference signal it may under some circumstances be advantageous to perform the adaptive equalization with respect to the error signal, since the shape of the error spectrum has some influence on the weighting of the cancellation filter coefficient adaptation as this is performed in closed-loop. Additionally, the error spectrum plays a role because a recursive algorithm is used for filter adaptation.

In the following, particular embodiments of the adaptive frequency estimation filter 7*a* are explained in detail with reference to FIGS. 4 to 9.

Figure 4:
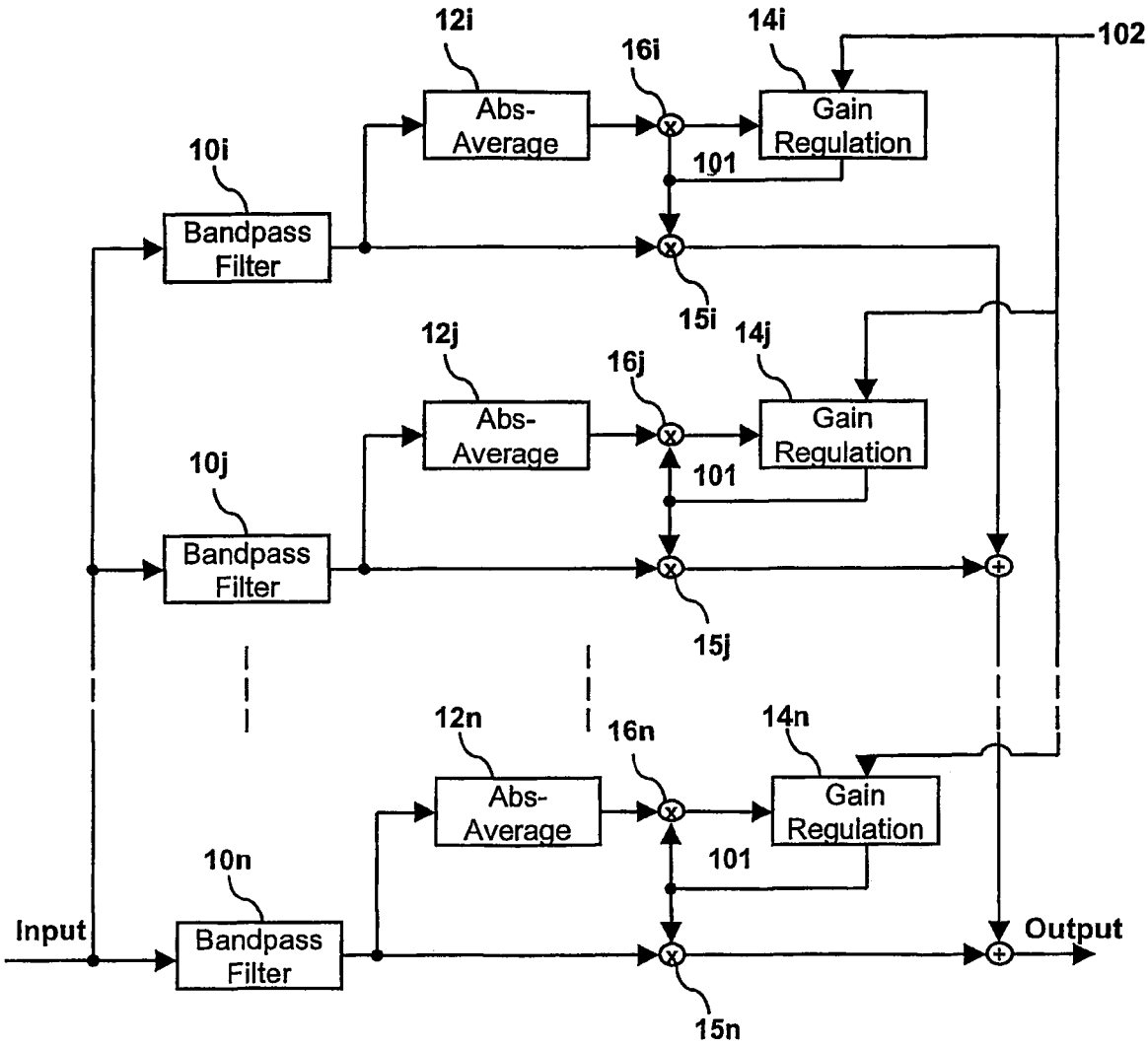
FIG. 4 is a block diagram showing a first embodiment of an adaptive equalization filter according to the present invention.
Figure 5:
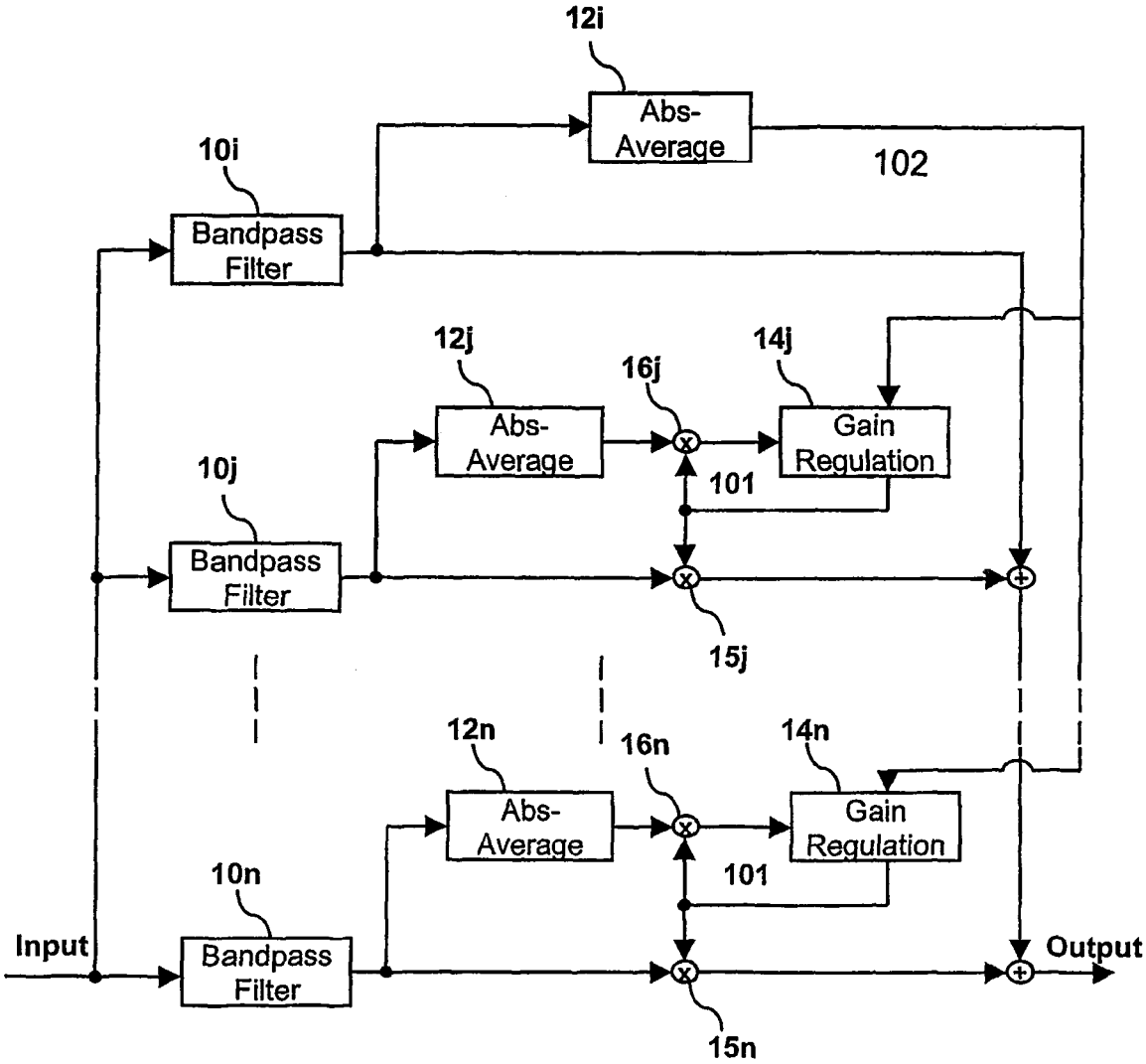
FIG. 5 is a block diagram showing a second embodiment of an adaptive equalization filter according to the present invention.

The embodiment of the equalization filter depicted in FIG. 4 comprises a plurality of band-pass filters 10*i*, 10*j*, . . . , 10*n* for dividing the input signal, which may, as has been discussed before, split the processor input signal (error signal), or the processor output signal (reference signal), into a plurality of frequency band signals. An appropriate number of band-pass filters, for example 4, 8 or 12 filters, may be utilized. The pass-band frequencies are preferably selected such that frequency ranges relevant for feedback cancellation are selected and irrelevant frequencies are omitted. In addition, such frequency ranges may be removed in which the occurrence of feedback is unlikely, due to the gain of processor 3 being very low at those frequencies.

For every frequency band signal a gain regulation unit 14*i*, 14*j*, . . . , 14*n* and an absolute average calculation unit 12*i*, 12*j*, . . . , 12*n* are provided. The gain regulation units compare a control signal 102 with the gain adjusted frequency band signal and derive a gain factor signal 101 defining the gain of the respective frequency band signal. The absolute average calculation units 12*i*, 12*j*, . . . , 12*n* calculate an absolute value signal, like e.g. a linear or quadratic norm signal averaged over a predetermined number of samples. The average of absolute values is an estimate of the $l_1$-norm (the linear norm). Other norms, e.g. $l_2$ (the quadratic norm), are also possible but require more computations. For an explanation of some of these norms, reference may be had to "Beta Mathematics Handbook" by Lennart Raade and Bertil Westergren, Studentlitteratur, Lund, Sweden, second edition, 1990, p. 335. The averaged absolute value signals are multiplied by multipliers 16*i*, 16*j*, . . . , 16*n* with the gain factor defined by gain factor signal 101 and then input to the gain regulation units 14*i*, 14*j*, . . . , 14*n*. The output signals of the band pass filters are multiplied by multipliers 15*i*, 15*j*, . . . , 15*n* with the same gain factor defined by gain factor signal 101 providing the output signals of the respective filter branches. The gain adjusted frequency band signals of all selected frequency ranges are then added to form the output signal submitted to the adaptive feedback estimation filter.

In FIG. 4, the control signal 102 controlling the plurality of gain regulation units 14*i*, 14*j*, . . . , 14*n* is an external signal, like e.g. an external selectable voltage value. The embodiment shown in FIG. 5 corresponds to the embodiment of FIG. 4 with the exception that control signal 102 is not an external signal but derived from the averaged absolute value of one of the frequency band signals. The frequency band defining the value of control signal 102, however, has to be selected wisely since the signal level in this frequency range serves as a basis for the frequency equalization of all other frequency bands.

The reason for using two multipliers 15*i*-15*n* and 16*i*-16*n* in every filter branch is that the gain regulation units 14*i*-14*n* are effected by the gain multiplication instantly (in contrast to the embodiments of FIGS. 6 to 9) providing a faster gain adjustment far outweighing the added computational requirement of a second multiplier.

Figure 6:
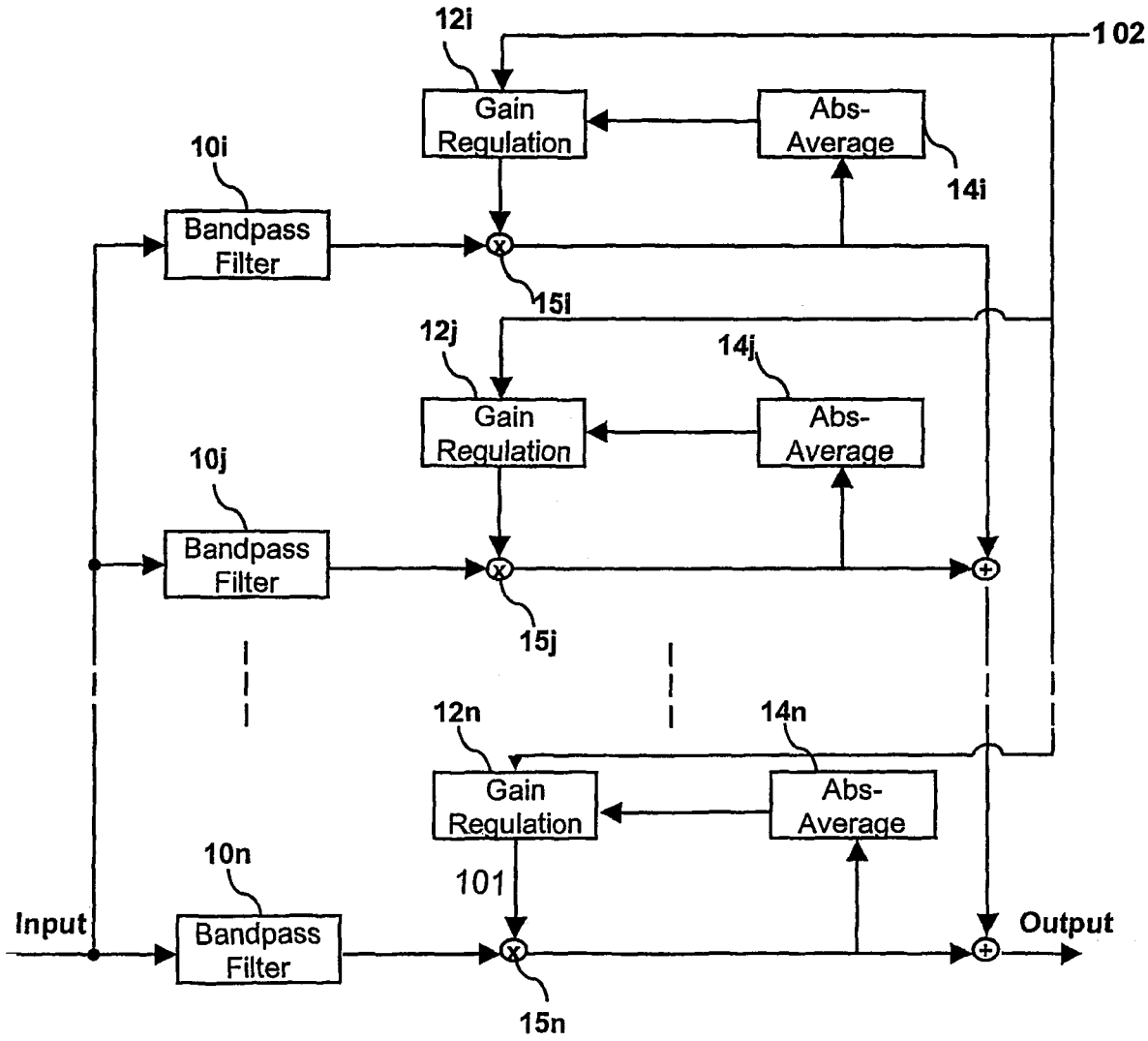
FIG. 6 is a block diagram showing a third embodiment of an adaptive equalization filter according to the present invention.
Figure 7:
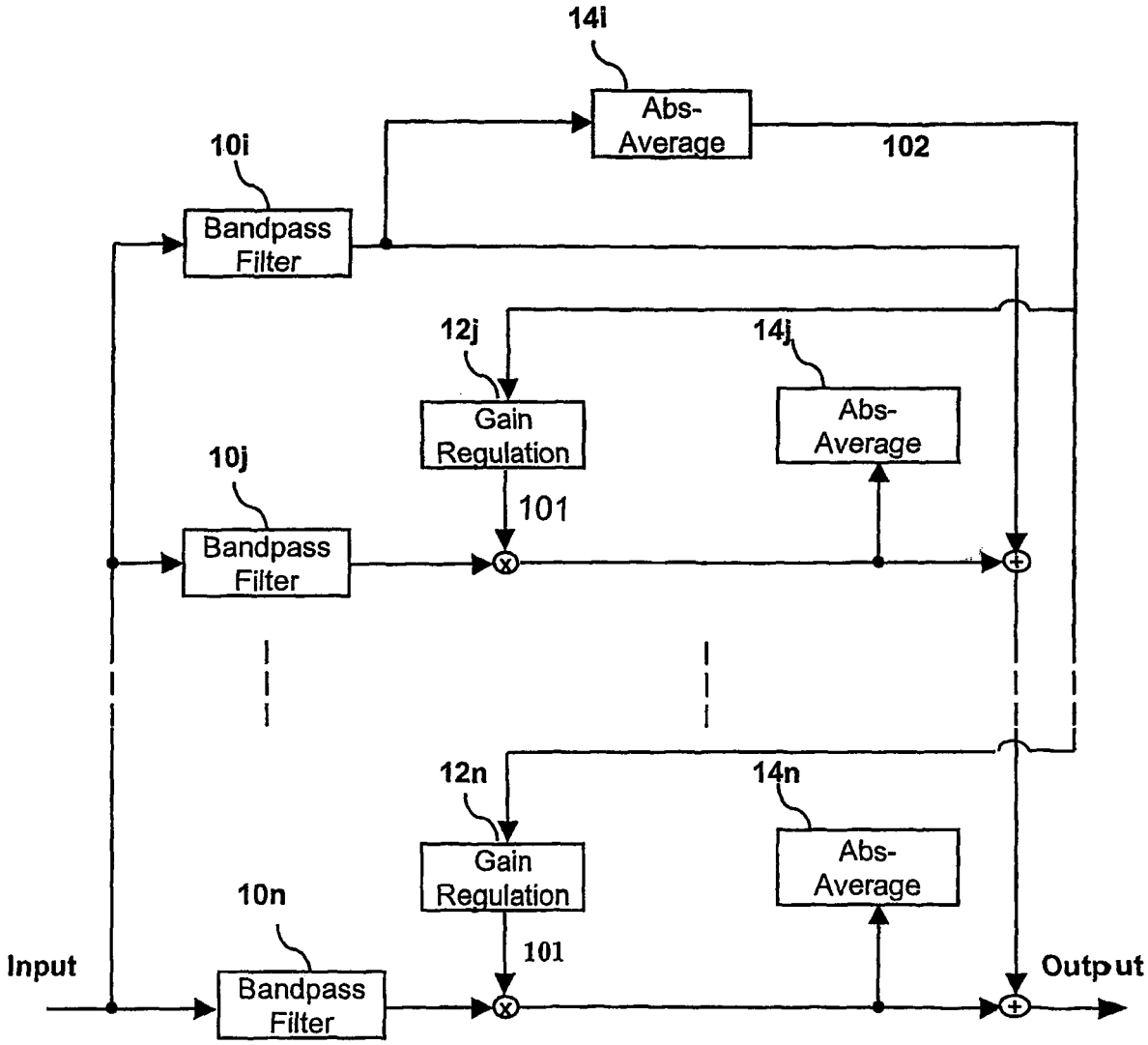
FIG. 7 is a block diagram showing a fourth embodiment of an adaptive equalization filter according to the present invention.

Further embodiments of the adaptive frequency equalization filter are shown in FIGS. 6 and 7. Instead of using two multipliers for every frequency band only one multiplier 15*i*-15*n* is utilized. In this configuration, the effect of the multiplication is delayed by the absolute average calculation units 14*i*-14*n*, resulting in a slower gain regulation and/or ripple of the output signal. Again, the embodiment of FIG. 6 utilizes an external control signal 102 while an internal control signal is calculated in the embodiment of FIG. 7.

Figure 8:
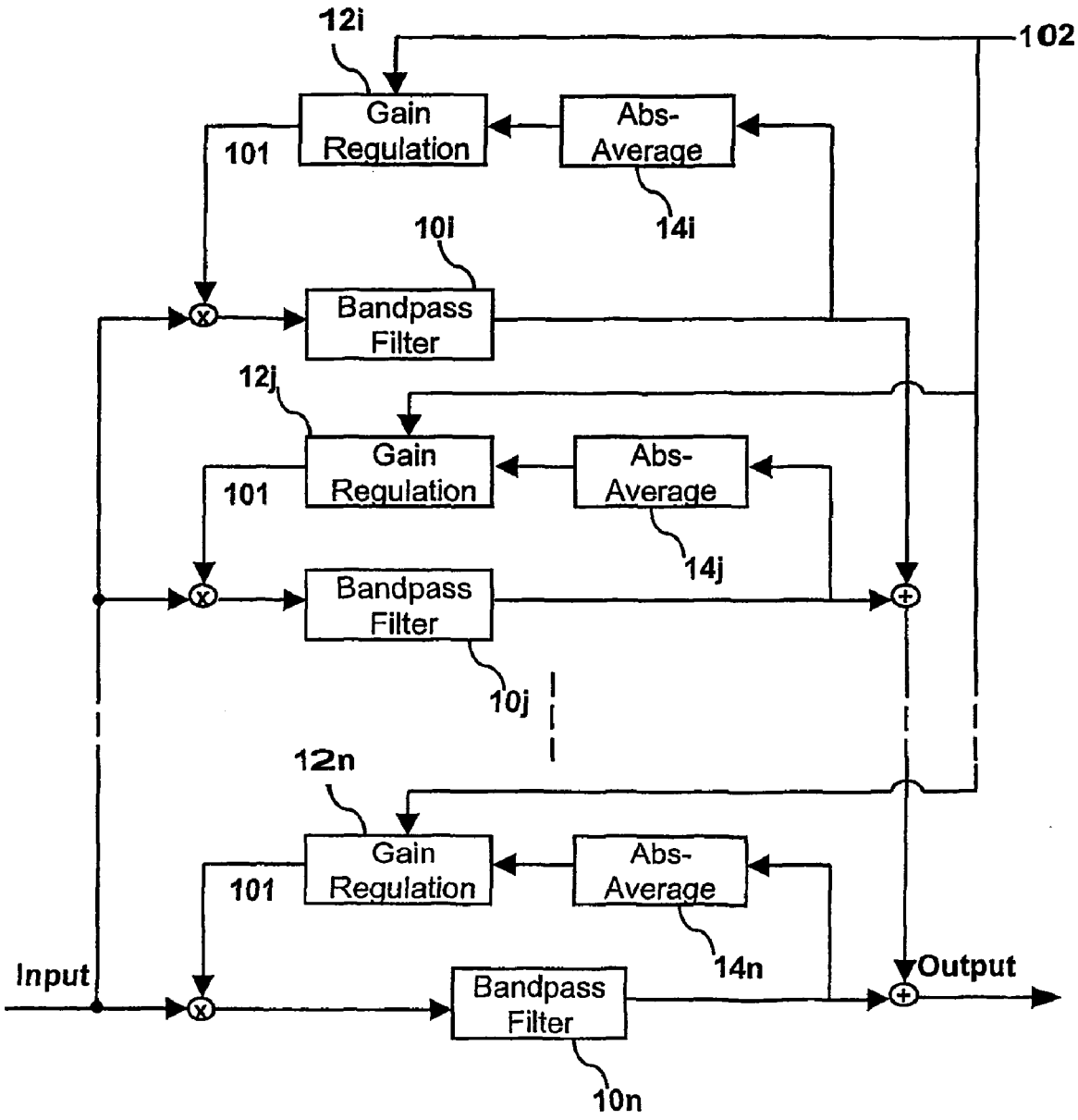
FIG. 8 is a block diagram showing a fifth embodiment of an adaptive equalization filter according to the present invention.
Figure 9:
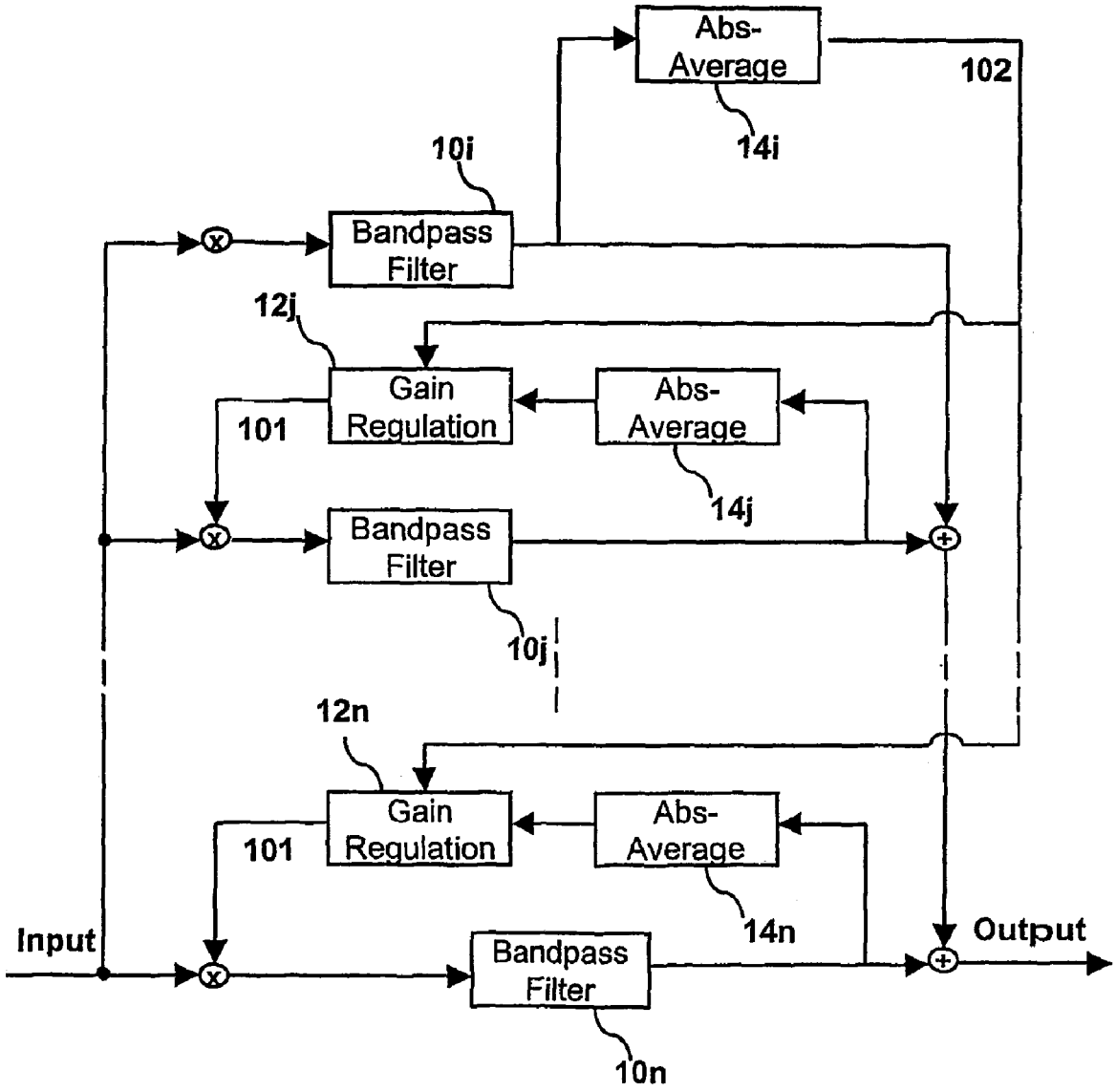
FIG. 9 is a block diagram showing a sixth embodiment of an adaptive equalization filter according to the present invention.

Still further embodiments of the adaptive equalization filter are shown in FIGS. 8 and 9. In these embodiments the multipliers are placed before the band-pass filters. This results in an even longer delay from the time of the gain regulation and until the effect is seen by the gain regulation unit. The advantage, however, of the arrangements of FIGS. 8 and 9 is that the multiplier can have a larger quantization as the bigger gain steps will be filtered out by the band-pass filters. Again, an external control signal is utilized with the embodiment of FIG. 8 and an internal control signal with the embodiment of FIG. 9.

In principle the multipliers providing the gain adjustment by multiplication with the gain factor signal can be connected anywhere in the respective filter branch, before the band-pass filter, after the band-pass filter, or somehow incorporated in the filters.

It should be acknowledged here that according to the present invention other types and methods for adaptive equalization filtering may be employed, as those shown in the embodiments of FIGS. 4 to 9. These methods include, as has been mentioned before, direct adaptation of a linear FIR or IIR filter to orthogonalize the input signal, or employing discrete Fourier transformation, equalization, then followed by inverse discrete Fourier transformation.

We claim:

1. A hearing aid comprising:

an input transducer for transforming an acoustic input into an electrical input signal, a subtraction node for subtracting a feedback cancellation signal from the electrical input signal thereby generating a processor input signal, a signal processor for deriving a processor output signal from the processor input signal, an output transducer for deriving an acoustic output from the processor output signal, a pair of equalization filters comprising a frequency selection unit for respectively selecting from the processor input signals and output signals a plurality of frequency band signals, and a frequency equalization unit for frequency equalization for the selected band signal, and an adaptive feedback estimation filter for adaptively deriving a feedback cancellation signal from the equalized frequency band signals.

2. The hearing aid according to claim 1, wherein a first, adaptive equalization filter comprises an adaptive frequency equalization unit for adaptively frequency equalizing the selected frequency band signals based on a control signal, and second non-adaptive equalization filter utilizes the equalization properties of the first equalization filter.

3. The hearing aid according to claim 2, wherein in the first equalization filter is connected to equalize the processor output signal and the second equalization filter is connected to equalize the processor input signal.

4. The hearing aid according to claim 2, wherein in the first equalization filter is connected to equalize the processor input signal and the second equalization filter is connected to equalize the processor input signal.

5. The hearing aid according to claim 2, wherein the control signal is an external control signal.

6. The hearing aid according to claim 2, wherein the control signal is derived from an averaged absolute value of one of the frequency band signals.

7. The hearing aid of one according to claim 2, wherein the first equalization filter comprises a plurality of band-pass filters serving as frequency selection unit, a plurality of absolute average calculation units for calculating an averaged absolute value of the plurality of frequency band signals and a plurality of gain regulation units deriving a plurality of gain factor signals dependent on a difference between the control signal and an averaged absolute value of the respective gain adjusted frequency band signal.

8. The hearing aid according to claim 7, wherein the first equalization filter comprises a plurality of multipliers for deriving the gain adjusted frequency band signals by multiplication of the frequency band signals with the corresponding gain factor signals.

9. The hearing aid according to claim 8, wherein the plurality of multipliers are connected behind the corresponding band-pass filters in the signal paths in a first equalization filter.

10. The hearing aid according to claim 8, wherein the plurality of multipliers are connected before the corresponding band-pass filters in the signal paths in a first equalization filter.

11. The hearing aid according to claim 9, wherein the first equalization filter comprises a plurality of second multipliers connected between the absolute average calculation units and the corresponding gain regulation units.

12. The hearing aid according to claim 7, wherein the absolute average calculation units calculate a norm of the frequency band signals.

13. A method of reducing acoustic feedback of a hearing aid having a signal processor for processing a processor input signal derived from an acoustic input and a feedback cancellation signal, and generating a processor output signal, the method comprising the steps of:

selecting from the processor input signals and output signals a plurality of frequency band signals, frequency equalizing the selected frequency band signals, and adaptively deriving a feedback cancellation signal from the equalized frequency band signals.

14. The method according to claim 13, wherein the step of frequency equalization includes adaptively equalizing the frequency band signals of the processor output signal and equalizing the frequency band signals of the processor input signal utilizing the equalization properties used for the processor input signal.

15. The method according to claim 13, wherein the step of frequency equalization includes adaptively equalizing the frequency band signals of the processor output signal and equalizing the frequency band signals of the processor output signal utilizing the equalization properties used for the processor output signal.

16. The method according to claim 14, wherein the step of adaptive frequency equalization comprises the step of controlling the gain factor of the plurality of frequency band signals by comparing a common control signal with an averaged absolute value of the gain adjusted frequency band signals.

17. The method according to claim 16, wherein an external control signal is utilized for adaptive frequency equalization.

18. The method according to claim 16, wherein a control signal derived from an averaged absolute value of one of the frequency band signals is utilized for adaptive frequency equalization.

19. The method according to claim 16, wherein the step of calculating averages of absolute values of the gain adjusted frequency band signals comprising calculation of norms of the frequency band signals.

20. A computer program product comprising a non-transitory computer-readable medium storing program code for performing, when run on a computer, a method of reducing acoustic feedback of a hearing aid comprising a signal processor for processing a processor input signal derived from an acoustic input and a feedback cancellation signal, and generating a processor output signal, the method comprising the steps of:

selecting from the processor input signals and output signals a plurality of frequency band signals, frequency equalizing the selected frequency band signals, and adaptively deriving a feedback cancellation signal from the equalized frequency band signals.

21. A hearing aid circuit comprising:

a signal processor for processing a processor input signal derived from an acoustic input and a feedback cancellation signal, and generating a processor output signal, a pair of equalization filters comprising:

a frequency selection unit for respectively selecting from the processor input signals and output signals a plurality of frequency band signals, a frequency equalization unit for frequency equalization for the selected band signal, an adaptive feedback estimation filter for adaptively deriving a feedback cancellation signal from the equalized frequency band signals.

* * * * *